US006959521B1

(12) United States Patent
Brooks

(10) Patent No.: US 6,959,521 B1
(45) Date of Patent: Nov. 1, 2005

(54) METHOD OF CREATING A WATERTIGHT BASEMENT STAIRWAY SIMULTANEOUSLY WITH FORMING A BUILDING FOUNDATION

(76) Inventor: Alan R. Brooks, 33 Third St., Leominster, MA (US) 01453

( * ) Notice: Subject to any disclaimer, the term of this patent is extended or adjusted under 35 U.S.C. 154(b) by 0 days.

(21) Appl. No.: 10/376,525

(22) Filed: Feb. 28, 2003

(51) Int. Cl.[7] ..... E04B 1/00
(52) U.S. Cl. ..... 52/745.05; 249/14
(58) Field of Search ..... 52/182, 107, 741.2, 52/742.14, 745.05, 745.1; 249/14, 34, 33; 264/31

(56) References Cited

U.S. PATENT DOCUMENTS 2,652,614 A * 9/1953 Como ..... 249/14
2,705,825 A * 4/1955 Dartez et al. ..... 249/14
2,880,491 A * 4/1959 Varnado, Sr. ..... 249/14
3,126,605 A * 3/1964 Davis ..... 249/14
3,147,531 A * 9/1964 Lyons ..... 249/14
3,269,688 A * 8/1966 Hulicki ..... 249/14
5,402,610 A * 4/1995 Salva' et al. ..... 52/182
5,511,347 A * 4/1996 Schwarz ..... 52/182

* cited by examiner

*Primary Examiner*—Robert P. Olszewski
*Assistant Examiner*—A. Joseph Wujciak
(74) *Attorney, Agent, or Firm*—Robert Nathans

(57) ABSTRACT

A concrete basement stairway is created, by positioning a stairway form 1 between a first pair of concrete receiving foundation channels 9 and a second pair of concrete receiving foundation channels 9*a* of any size foundation, the stairway form including a single piece stairstep panel 2, coupled by pivotable latching members, between a pair of parallel inner stairway side panels 6 and 6*a*, the inner stairway side panels configured to permit concrete to flow between the two pairs of concrete receiving foundation channels and spaces beneath the stairstep panel, in a manner forming a series of solidified concrete steps unified, and thus leak proof, with concrete solidified within the concrete receiving foundation channels. The stairway is formed simultaneously with the foundation so that a builder can complete the job without awaiting shipment of a pre-cast stairway requiring returning to the site. Reusable lightweight aluminum forms are employed for easy handling.

20 Claims, 7 Drawing Sheets

METHOD OF CREATING A WATERTIGHT BASEMENT STAIRWAY SIMULTANEOUSLY WITH FORMING A BUILDING FOUNDATION

BACKGROUND OF THE INVENTION

The present invention relates to the field of construction of variable sized houses having poured concrete foundations.

In the conventional manner, vertically oriented wall foundation forms that receive poured concrete are used to create the concrete foundation for homes having various sizes. Normally, after the foundation is poured to almost complete the foundation, a pre-cast concrete stairway is then bolted to the foundation walls to provide access to the basement from the outside. One such pre-cast stairway is distributed in the marketplace by American Concrete Industries of Auburn Me. 04210. Another is offered by "Steelway Custom Cellar Doors" of Conshohocken, Pa. 19428. A rubber gasket is sometimes fitted between the completed foundation walls and the pre-cast concrete stairway to stop future destructive potential ground water leaks between the later installed art pre-formed stair block and the earlier poured foundation. However, there are problems with this conventional procedure. One problem is that the gasket, if it is installed at all, often ages with the passage of time, causing water to later leak into the basement to produce damage, and thus it would be advantageous to eliminate the gasket or the potential destructive entrance of water in the absence of the use of the gasket. Another problem with the normal procedure is that the builder often must wait for the often delayed shipment of the pre-cast concrete stairway to the construction site to complete the job. No patent was found during the on line novelty search that would be helpful for a home builder in solving these problems. While U.S. Pat. No. 4,539,780 to Rice discloses four stair steps, unitary with an underground storm shelter component, the small, self-contained, two-piece storm shelter of Rice is portable from the point of manufacture of sale of the concrete product to the point of use, in contrast with the present invention, and has nothing to do with the aforesaid problems in connection with various sized building foundations. It is therefore the principal object of the present invention to solve these problems in an easy and economical manner.

SUMMARY OF A PREFERRED EMBODIMENT OF THE INVENTION

The aforesaid goals are substantially met in accordance with the embodiment of FIG. 1, whereby a leak proof concrete basement stairway is created, unitary with any size building foundation, by positioning a stairway form 1 between a first pair of vertically oriented concrete receiving foundation channels 9 and a second pair of vertically oriented concrete receiving foundation channels 9*a* of any variable size foundation, the stairway form including a single piece stairstep panel 2 coupled between a pair of parallel inner stairway side panels 6 and 6*a*, the inner stairway side panels configured to permit concrete to flow between the two pairs of concrete receiving foundation channels and spaces beneath the stairstep panel in a manner forming a series of solidified concrete steps unified with concrete solidified within the concrete receiving foundation channels, and thereafter causing concrete to simultaneously fill the foundation channels and the spaces beneath the stairstep panel. Reusable lightweight aluminum form components are employed for easy handling.

BRIEF DESCRIPTION OF THE DRAWINGS

Other features and advantages of the present invention will become more apparent upon reading the detailed description, taken in conjunction with the drawings in which.

DETAILED DESCRIPTION OF A PREFERRED EMBODIMENT OF THE INVENTION

Figure 1:
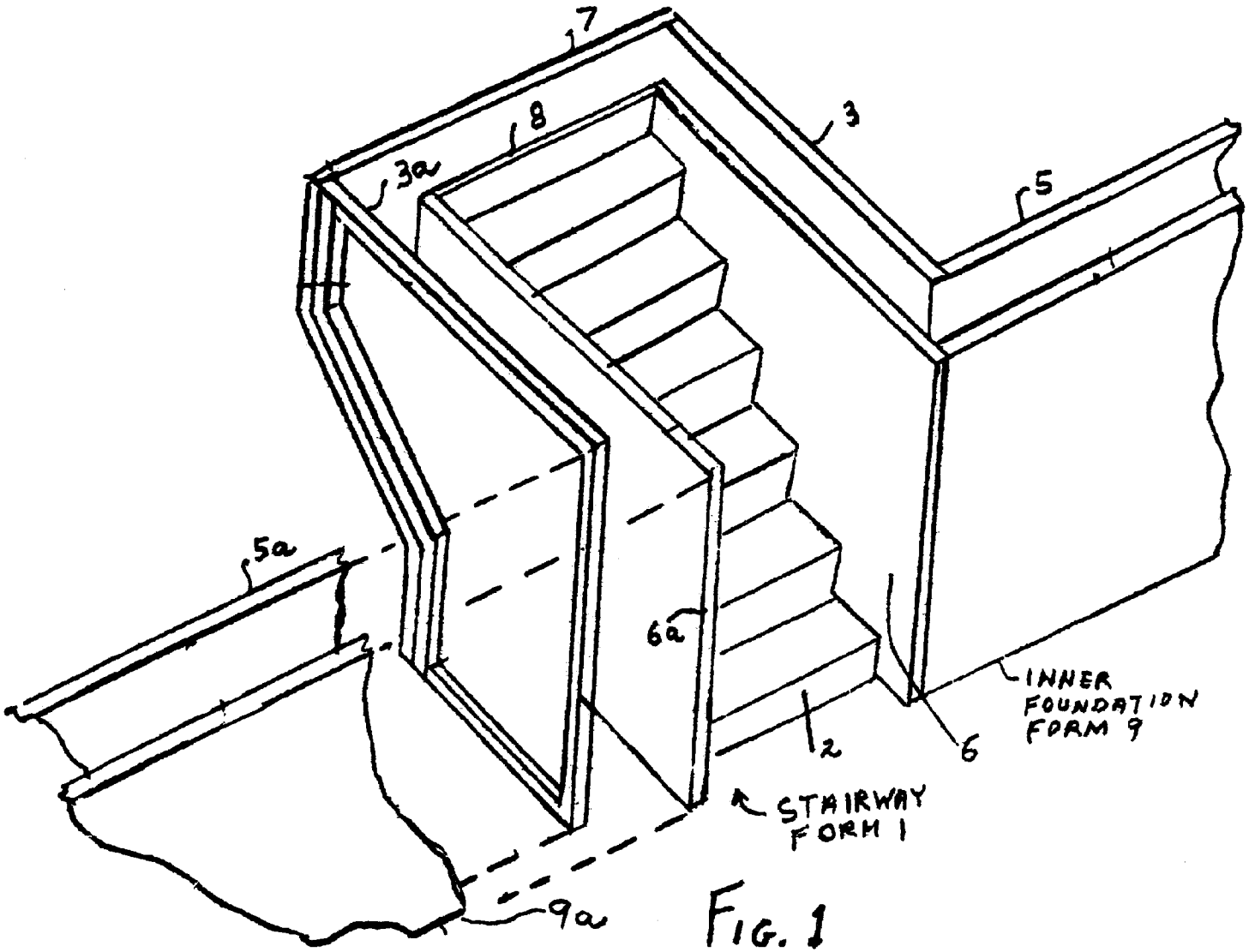
FIG. 1 discloses a schematic perspective of the final assembly of the lightweight forms and panels before pouring of concrete to simultaneously produce a custom sized home foundation along with a stairway entrance and exit to and from the basement.

The method of the invention is preferably carried out by first latching the right and left outside side panels 3 and 3*a* to the outside wall foundation forms 5 and 5*a* respectively. See FIGS. 1 and 2. The back stairway form outside panel 7 is now latched to the outer panels 3 and 3*a* respectively. The two inner stairway side panels 6 and 6*a* are latched to the inner wall foundation forms 9 and 9*a* respectively. The type of preferred latch members are shown and described in connection with FIGS. 5 and 6 below.

Figure 2:
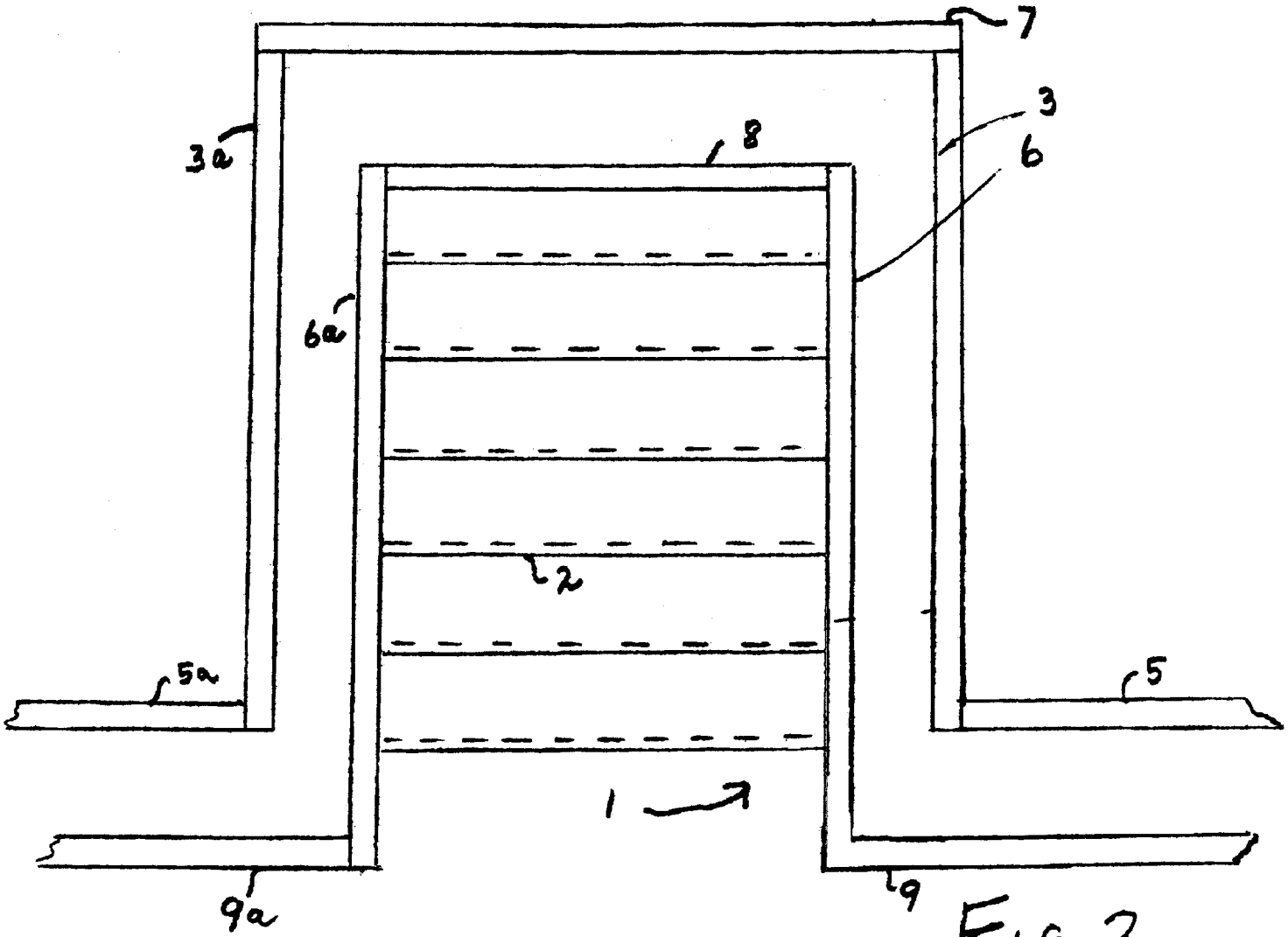
FIG. 2 is a top view of the inner and outer stairway forms positioned between terminal portions of the inner and outer foundation wall forms, all being latched together by latches, not shown.
Figure 4:
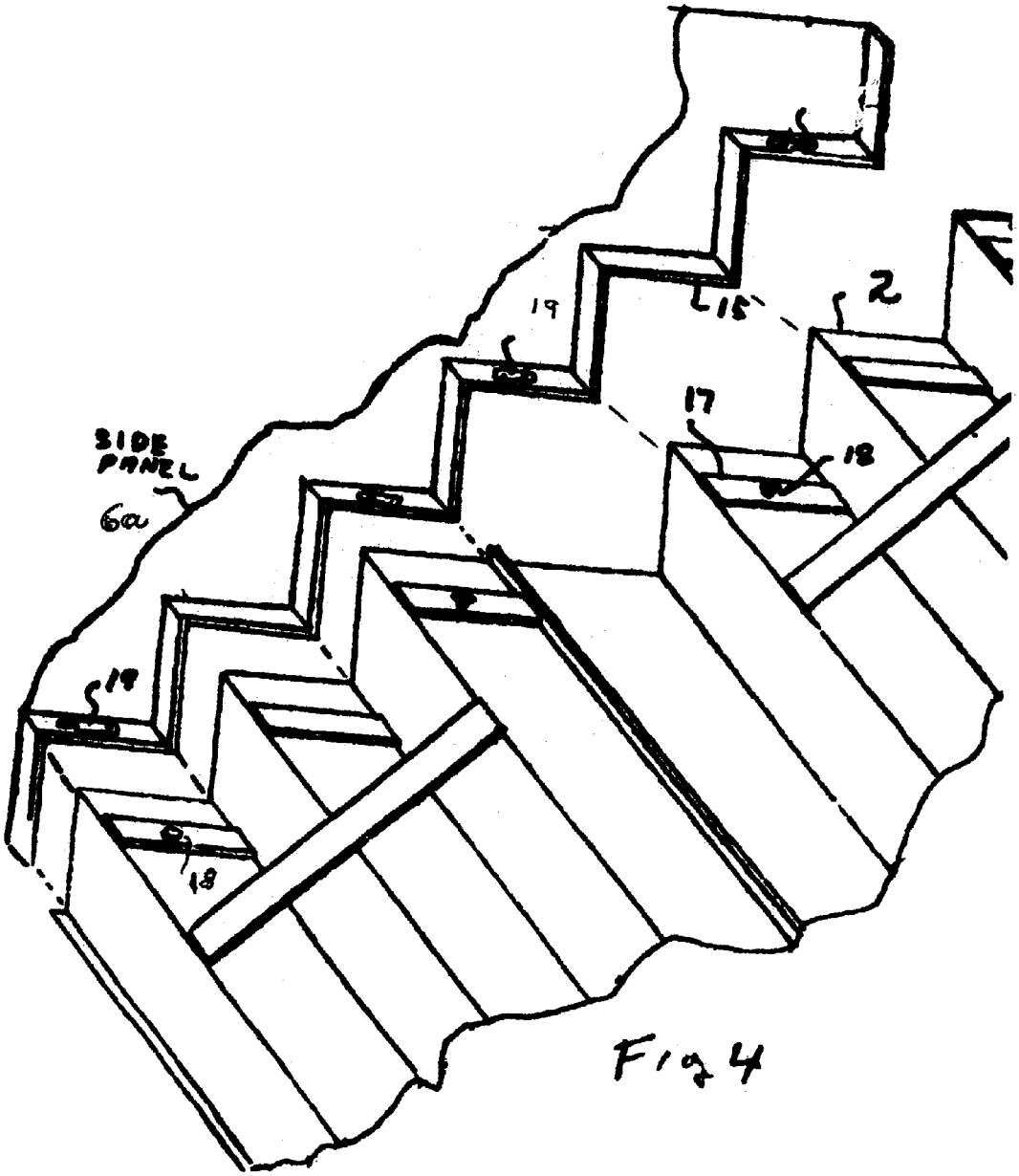
FIG. 4 is a perspective view of the stair step panel and a portion of an inner side panel showing how the components are latched together.
Figure 5:
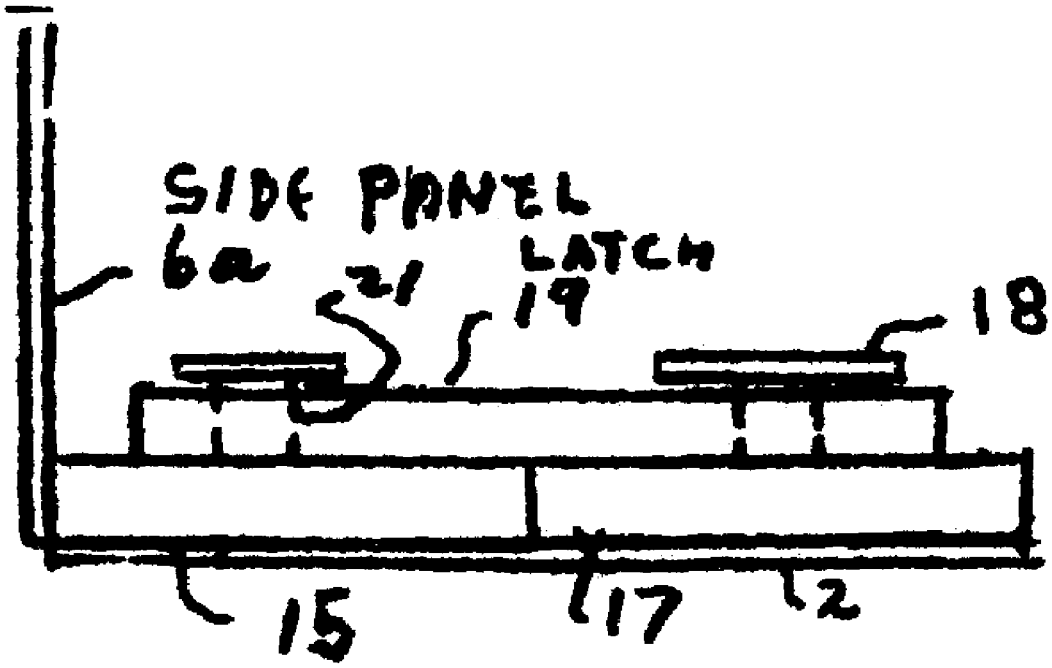
FIG. 5 shows a pivotable latch extending from and supported by the side panel used in FIG. 4.

The single piece stair step panel 2 is slid between the left and right inner stairway side panels 6 and 6*a* and coupled thereto by the latching arrangement shown in FIGS. 4 and 5. The inside back stairway form 8 shown in FIG. 1 is latched to the inner stairway side panels 6 and 6*a*. A conventional doorway hatch cover top piece is normally later added and is not shown in the interests of clarity. The plan view of FIG. 2 illustrates the aforesaid components of FIG. 1 and the concrete receiving spaces between the inner composite piece stairway form 1 and the outer panels 3, 7 and 3*a*. All forms are preferably of aluminum because it is more durable and lightweight, providing ease of handling. The forms are reusable and should last for many years if properly cared for.

A key feature or objective of the invention is to simultaneously form the concrete foundation and the stairway in a single operation as previously described. Thus, the concrete is poured to completely fill all of the parallel vertically oriented spaces between the forms shown in FIGS. 1 and 2 right up to their upper edge portions of walls 7 and 8, 3 and 6, 3*a* and 6*a*, 5 and 9 and 5*a* and 9*a*. In other words the forms are completely filled from their bottoms to their tops. When the pouring of the concrete is finished, the concrete has to usually be graded off of the tops of the forms to even the level of the upper edge portions. Thus, space 2*a* shown in FIG. 3 beneath the stair step form 2 receives poured concrete to meet this objective and to also eliminate the aforesaid potential water leakage between the stair steps and the foundation. The space above the stair step form receives no concrete due to the blocking action of all of the several steps of form 2 and the sidewalls 6 and 6*a*. This forms the stairway area for access to and from the basement. If additional stair steps are needed than those shown, additional pieces can be added to be attached to the upper stairway form portion to receive added amounts of poured concrete and the foundation forms would be slightly higher to increase the top level of the concrete. The figures show only terminal portions of the foundation forms, such foundation being of any size and configuration as specified by the builder.

Figure 3:
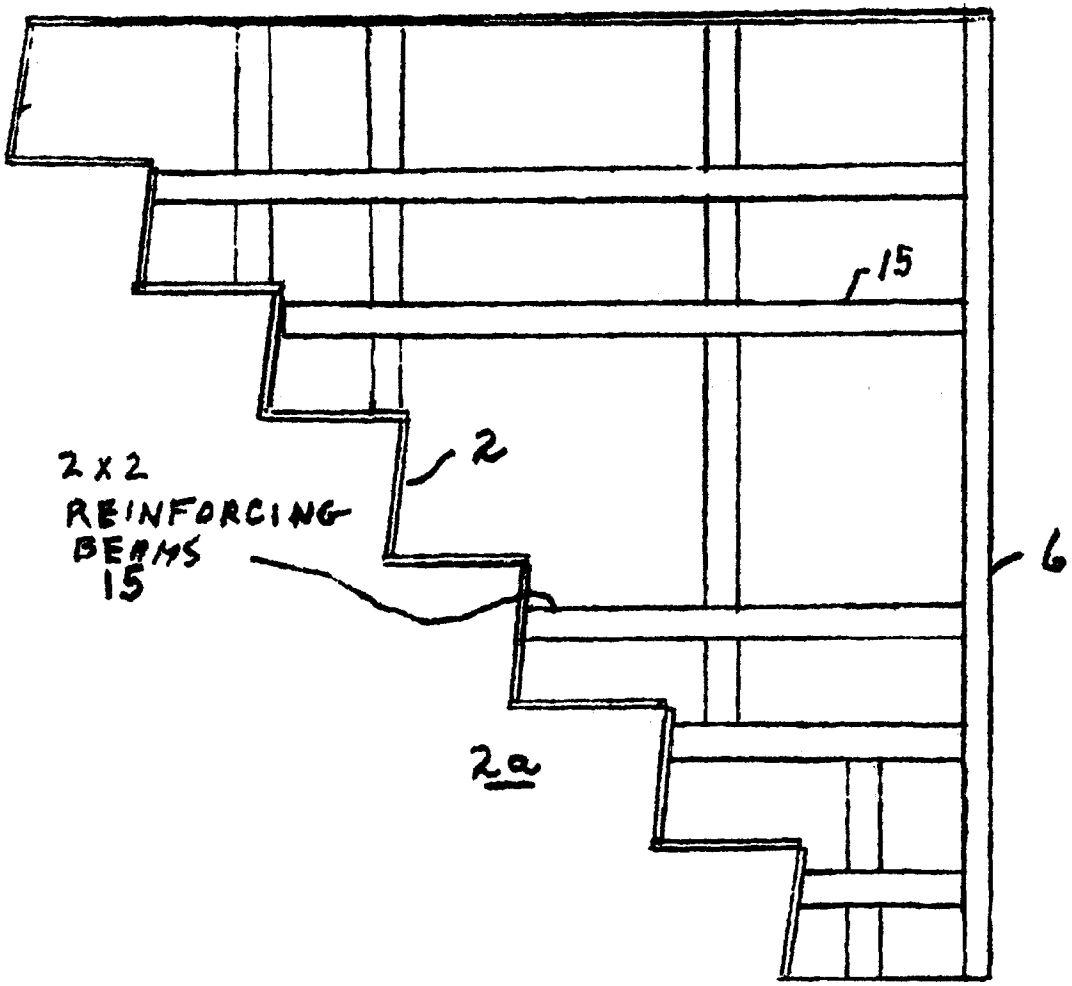
FIG. 3 is a side view of a right hand inner stairway side panel, the left hand stairway side panel being identical thereto, reinforcing members also being disclosed.

FIG. 3 is a side view of single piece stair step form 2, a right hand inner stairway side panel 6, the left hand stairway side panel being identical thereto, along with reinforcing members 15 also being disclosed. Such reinforcing members can have numerous sizes and shapes and in the constructed prototypes consist of rigid aluminum stiffening channels welded to the panel forms and positioned to resist the weight of the concrete. These reinforcing beams can be used in connection with other panel forms such as the rear panel forms 7 shown in FIGS. 1, 2 and 6.

FIGS. 4 and 5 illustrates how the stair step form is coupled between the stairway form sidewalls 6 and 6*a* upon assembly. FIG. 4 is a perspective view of the single piece stair step form 2 and a portion of an inner side wall panel 6*a* with a latching ledge 15 of FIG. 5 affixed thereto, such ledge bearing rotatable latching members 19 pivotally coupled to the ledges via pivot members 21 shown in FIG. 5. The latching members are pivoted to easily and rapidly couple them to latching pins 18, affixed to the stairway form 2 as shown via members 17 affixed to the stair step form. A latch on every other step has been found to be adequate. Each stair step is typically 9.5 inches in width and eight inches in height. This arrangement readily enables various width stair step forms to be employed if desired. There are seven stair steps in the basic form and two additional adapting pieces to make a total of nine steps to be used as needed. The reason for the additional pieces is for the determination of the back fill of the foundation as needed.

Figure 6:
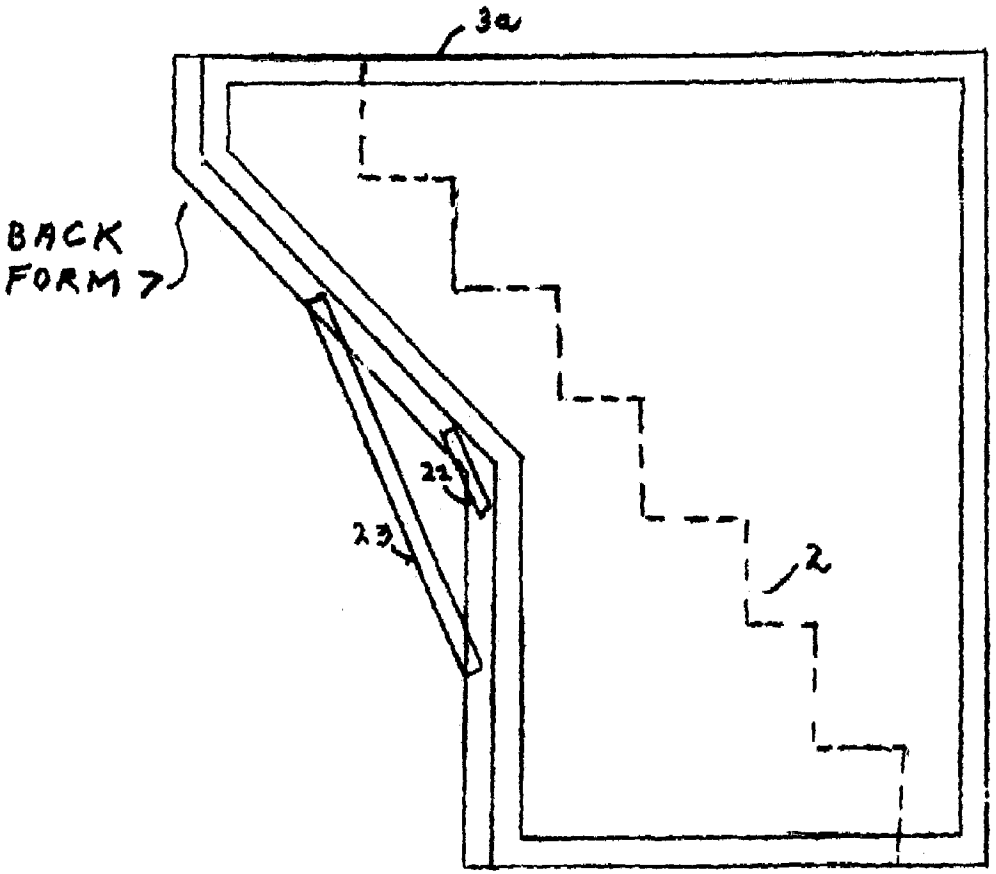
FIG. 6 shows the reinforced back wall outside form that is positioned between both outer side panels, the inner stairstep form being shown in dashed lines.

FIG. 6 shows the back wall outside form 7, that is latched or otherwise coupled to the left and right side outer panels 3 and 3*a*, the inner single piece stairway form 2 being shown in dashed lines. Reinforcing beams 22 and 23 can be affixed to the back form 7 to resist deformation of the form due to the weight of the concrete. Such reinforcing forms are used wherever appropriate throughout as would be apparent to workers in the art.

Figure 7:
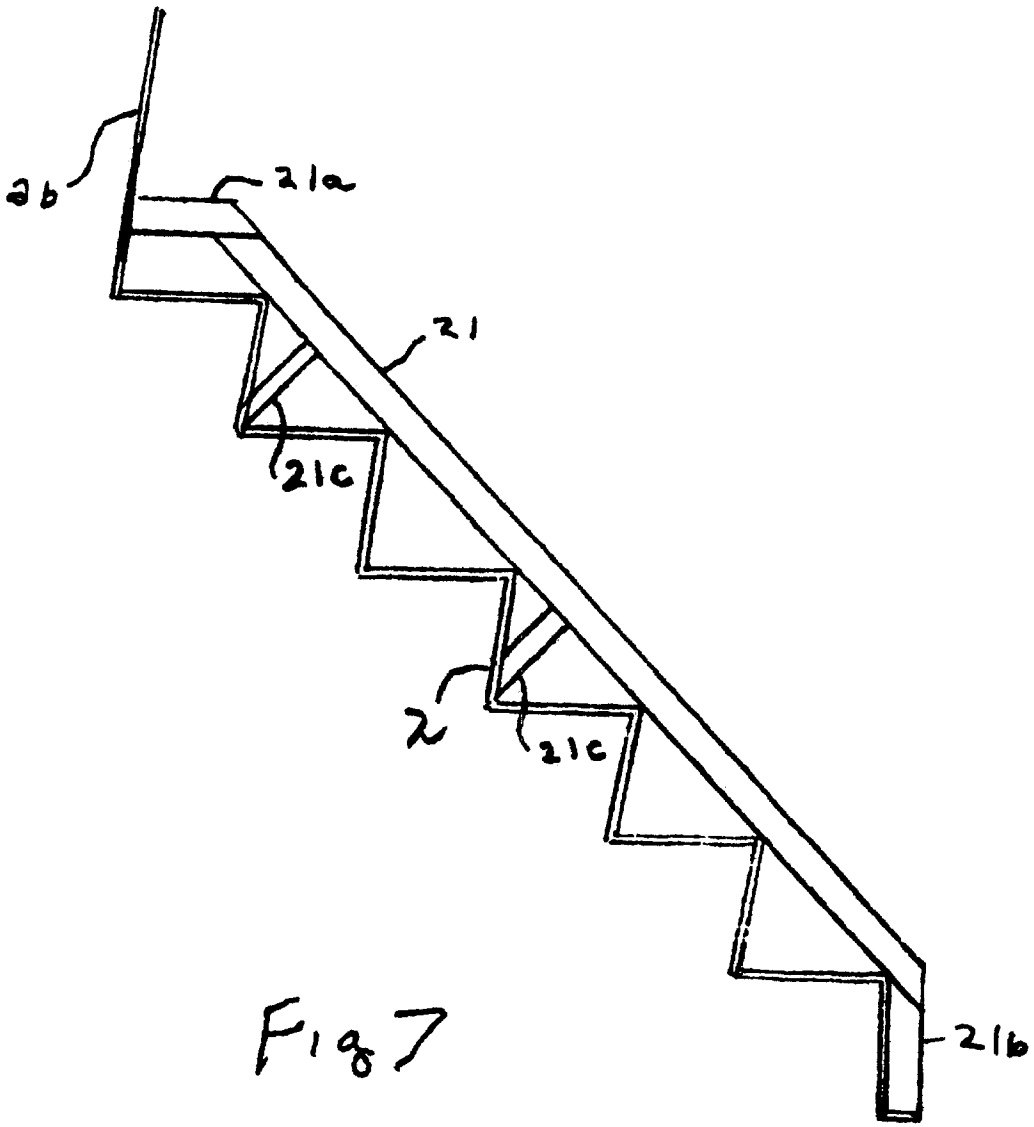
FIG. 7 shows one of a pair of rigidifying reinforcing members used in connection with the stairstep form.

FIG. 7 shows the stairstep form 2 with one of two attached reinforcing beams 21 that can be used, with portion 21*a* affixed to top portion 2*b* of the stairstep form that stops the poured concrete from spilling over the stairstep form in the neighborhood of 8 in FIG. 1. One beam 21 is attached to the right hand portion of the stairstep form, parallel with its length, and the other beam (not shown) is attached to the left hand portion of the stairstep form parallel with its length. The lower portion 21*b* is attached to the lowermost step of the stairstep form, and thus beam 21 acts to maintain the steps of the form 2 in place without distortion of the shapes of the step portions due to pressure from the heavy concrete.

Since numerous variations of the foregoing will occur to the worker in the art, the scope of the invention is to be restricted solely to the terms of the following claims and art recognized equivalents thereof. For example, panel coupling devices other than the described rotatable latches could be employed wherever needed. The reinforcing beams could have many sizes and shapes and could be affixed to the panel sheets in ways other than by welding. The term "concrete" is intended to cover any presently existing or future material which functions in a similar manner as concrete in the construction of a building foundation.

What is claimed is:

1. Method of creating a basement stairway unitary with a building foundation comprising the steps of:

(a) positioning a stairway form between a first and second concrete receiving foundation form of any size concrete receiving foundation, said stairway form including a stairstep panel coupled between a pair of stairway side panels, said stairway side panels configured to permit concrete to flow between said first and second concrete receiving foundation forms and spaces beneath said stair step panel in a manner forming a series of solidified concrete steps unified with concrete solidified within said first and second concrete receiving foundation forms; and (b) thereafter causing concrete to fill said first and second concrete receiving foundation forms and said spaces beneath said stair step panel; and (c) wherein step (a) includes coupling said stair step panel between said pair of stairway side panels by latch members positioned therebetween.

2. The method of claim 1 wherein said stairway form is coupled between said first and second concrete receiving foundation forms by latch members.

3. A method of creating a leak proof concrete basement stairway that can be formed by pouring concrete simultaneously with a foundation section of a building comprising the steps of:

(a) positioning a stairway form having concrete receiving channels between and in contact with concrete receiving channels of first and second concrete receiving building foundation forms of any size and configuration as specified by a builder, said stairway form comprising (a-1) a stairstep forming panel positioned between a pair of inner stairway side panels;

(a-2) a pair of outside side panels spaced from said inner stairway side panels creating stairway form side concrete receiving channels;

(a-3) back stairway form panel structure creating additional stairway form concrete receiving channels; and (b) causing concrete to fill channels of said first and second building foundation forms along with concrete receiving channels set forth in paragraphs (a-2) and (a-3), all at substantially the same time.

4. The method of claim 3 wherein a plurality of latch members couple said stairstep forming panel between said inner stairway side panels.

5. The method of claim 4 wherein said stairway form is coupled between said first and second building foundation forms by a plurality of latch members.

6. The method of claim 4 wherein said stairstep forming panel is made of a single piece.

7. The method of claim 5 wherein said stairstep forming panel is made of a single piece.

8. The method of claim 4 wherein panels of said stairway form are made of lightweight aluminum.

9. The method of claim 5 wherein panels of said stairway form are made of lightweight aluminum.

10. The method of claim 3 wherein said stairway form is coupled between said first and second building foundation forms by a plurality of latch members.

11. The method of claim 10 wherein said stairstep forming panel is made of a single piece.

12. The method of claim 10 wherein panels of said stairway form are made of lightweight aluminum.

13. The method of claim 3 wherein said stairstep forming panel is made of a single piece.

14. The method of claim 3 wherein panels of said stairway form are made of lightweight aluminum.

15. A method of creating a leak proof concrete basement stairway along with creation of a section of a building foundation comprising the steps of:

(a) positioning a stairway form, for forming said leak proof concrete basement stairway, between first and second building foundation forms of any size and configuration as specified by a builder, said stairway form including a stairstep forming panel and having concrete receiving channels in contact with concrete receiving channels of said first and second building foundation forms; and (b) causing concrete to substantially simultaneously fill said concrete receiving channels of said first and second building foundation forms, along with concrete receiving channels of said stairway form.

16. The method of claim 15 wherein a plurality of latch members couple said stair-step forming panel between a pair of inner stairway side panels.

17. The method of claim 16 wherein said stairway form is coupled between said first and second above ground building foundation forms by a plurality of latch members.

18. The method of claim 15 wherein said stairway form is coupled between said first and second above ground building foundation forms by a plurality of latch members.

19. The method of claim 15 wherein said stairstep forming panel is made of a single piece.

20. The method of claim 15 wherein panels of said stairway form are made of lightweight aluminum.

* * * * *